US006097137A

United States Patent [19]

Forsdyke et al.

[11] Patent Number: 6,097,137

[45] Date of Patent: Aug. 1, 2000

[54] ELECTRODELESS DISCHARGE LAMP

[75] Inventors: Graham M. Forsdyke; Stuart A. Mucklejohn; Mahamed H. Girach, all of Leicestershire, United Kingdom

[73] Assignee: General Electric Company, Schenectady, N.Y.

[21] Appl. No.: 08/800,244

[22] Filed: Feb. 12, 1997

[30] Foreign Application Priority Data

Feb. 15, 1996 [GB] United Kingdom ..... 9603197

[51] Int. Cl.[7] ..... H01J 29/76

[52] U.S. Cl. ..... 313/161; 313/160; 313/635

[58] Field of Search ..... 313/160, 161, 313/162, 635, 594, 607; 315/248

[56] References Cited

U.S. PATENT DOCUMENTS

| | | | |
|---|---|---|---|
| 5,124,618 | 6/1992 | Ohtaka et al. . | |
| 5,243,251 | 9/1993 | Inukai et al. | 313/25 |
| 5,291,091 | 3/1994 | Eggink et al. | 313/161 |
| 5,808,414 | 9/1998 | Wharmby et al. | 313/607 |

FOREIGN PATENT DOCUMENTS

| | | |
|---|---|---|
| 0 350 359 A1 | 5/1986 | European Pat. Off. . |
| 0 181 197 Aa1 | 1/1990 | European Pat. Off. . |
| 0 512 622 A1 | 11/1992 | European Pat. Off. . |
| 0 660 375 A2 | 6/1995 | European Pat. Off. . |

OTHER PUBLICATIONS

Patent Abstracts of Japan; Publication No. 02158050; Publication Date Jun. 18, 1990; Application Date: Dec. 12, 1988; Appl. No. 63313156.

European Search Report.

*Primary Examiner*—Nimeshkumar D. Patel
*Assistant Examiner*—Michael J. Smith
*Attorney, Agent, or Firm*—Fay, Sharpe, Fagan, Minnich & McKee, LLP

[57] ABSTRACT

An electrodeless discharge lamp comprises a sealed discharge vessel containing a fill capable of sustaining a discharge when suitably energized, and circuitry for energizing a solenoid to produce an RF electromagnetic field in the vessel to energize the fill. A light transmissive, inherently conductive, polymer layer is provided on the exterior of the discharge vessel for confining the RF field within the lamp. An outer, insulating layer may also be provided over the conductive layer.

12 Claims, 1 Drawing Sheet

ELECTRODELESS DISCHARGE LAMP

Figure 1:
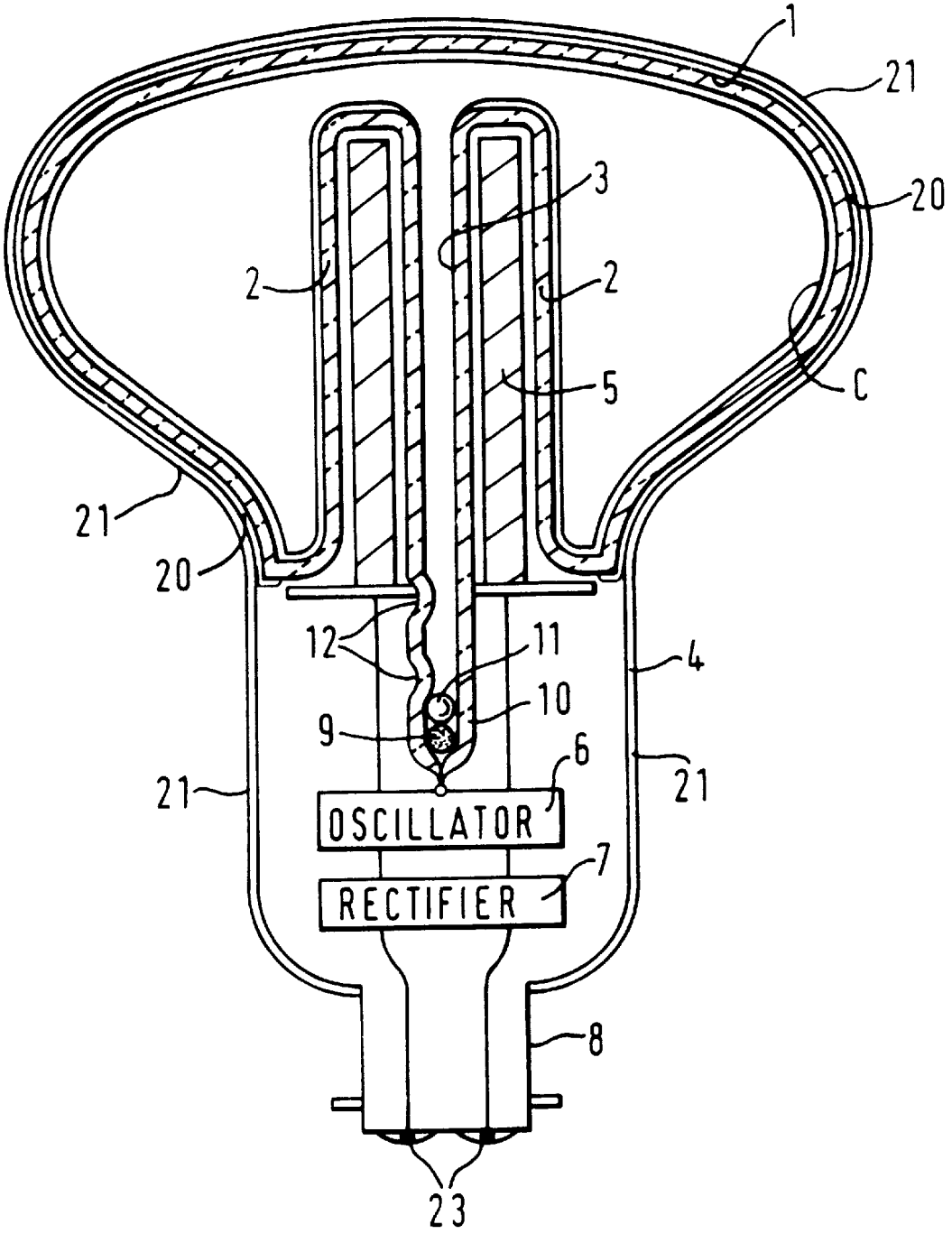

The present invention relates to an electodeless discharge lamp.

Such a lamp is known from, e.g. EP-A-660375 (PQ 619). Such a lamp comprises a discharge vessel having a reentrant portion housing a solenoid which is energised by an RF current to generate an RF electromagnetic field in the vessel. The vessel has an internal transparent, electrically conductive coating (except on the reentrant) to confine the RF field within the vessel. Circuitry for energising the solenoid is housed in a metal housing which is coupled to RF ground for suppressing electro-magnetic interference. The internal coating is also capacitively coupled to RF ground to further prevent electromagnetic interference.

The transparent conductive coating is difficult to form inside the vessel and it is difficult to capacitively couple it to RF ground.

It is also known, from EP-A-0,512,622 to provide an interference-suppressing, transparent, electrically conductive layer on the outside of a discharge vessel. This external conductive layer is of tin-doped indium oxide, and induced currents are drained to the mains supply by means of a capacitor.

According to the present invention, there is provided an electrodeless discharge lamp comprising a sealed discharge vessel containing a fill capable of sustaining a discharge when suitably energised, means for producing an RF electromagnetic field in the vessel to energise the fill, and means for confining the field within the lamp, the confining means including a light transmissive inherently conductive polymer layer on the external surface of the discharge vessel.

For a better understanding of the present invention, reference will now be made by way of example to the accompanying drawing in which:

FIG. 1 is a schematic, cross-sectional view of an electrodeless fluorescent lamp according to the present invention.

The lamp of FIG. 1 comprises a sealed discharge vessel 1 of glass having a re-entrant portion 2 through which an exhaust tube 3 extends from a distal end of the reentrant portion 2 into a housing 4. The re-entrant portion 2 contains a solenoid 5. The solenoid is energised by an RF oscillator 6 powered via a rectifier 7 from the mains. The oscillator 6 and rectifier are housed in the housing 4 which supports a lamp cap 8 such as an Edison-screw (not shown) or bayonet cap.

The vessel contains a fill as known in the art, the fill comprising inter alia, mercury vapor provided by amalgam 9 held in the end 10 of the tube 3 by a glass ball 11 and dimples 12.

The inner surface of the discharge vessel has a coating C formed by at least:

a) a layer of material as known in the art which prevents blackening of the glass in long term usage of the lamp; and b) phosphor as known in the art.

A discharge is induced in the fill by an RF electromagnetic field produced by the solenoid 5 resulting in the phosphor emitting visible light.

In accordance with the present invention, means are provided to confine the RF field within the lamp, the means including an inherently conductive polymer layer 20 which is light transmissive, on the outside of the vessel. The polymer layer comprises a host material containing one or more of the following:

Polyaniline

Polypyrrole

Polythiophene

Polyphenanthro-isothionaphthene

All of these may be used in a substituted derivative form and not only parent compound.

The host material is preferably a clear silicone such as LIM60-30 available from General Electric Company.

The layer 20 may be either a dip coat or a preformed moulding.

To provide electric shock protection a further light transmissive electrically insulative layer 21 is provided over the conductive layer 20.

Preferably the housing 4 is a single piece metal stamping the edge of which either directly contacts the discharge vessel and/or is fixed to it by conductive adhesive. In that case, as shown, the insulative layer 21 extends over and insulates the housing 4. The cap 8 is then of insulative material and/or the lamp contacts 23 are insulated from the housing 4. In this case the layer 20 is either dipcoated or preformed and the layer 21 is separately formed either as a dipcoating or a preform.

Alternatively, the housing 4 is of insulative material and contains a metal can housing the oscillator and rectifier, the can being coupled to RF ground, and the conductive layer 20 for confining the RF field within the lamp is also coupled to RF ground.

In this case, the layers 20 and 21 may be co-formed or may be separately formed by dipcoating or preforming.

The external electrically conductive polymer layer 20 provides the following advantages:

The shield is transparent causing minimal light loss.

The shield is in close contact with the glass therefore providing improved shielding.

The shield is on the outside of the bulb which allows ease of manufacture and assembly. The use of a polymer layer enables the shield to be applied, using simple known techniques, in the final stages of manufacture. Previously, using an inorganic shielding layer, it was necessary to form the shielding layer during production of the glass envelope of the discharge vessel, using relatively complex processes.

The shield is held in a flexible medium which is better resistant to shock and damage.

The use of a polymer shield makes it easy to apply an additional, insulating, layer of a compatible polymeric material as the outermost layer, with reliable adhesion and integrity.

In another alternative, the housing 4 is of insulative material and shielding is applied to components or groups of components with the oscillator and rectifier which radiate RF.

What is claimed is:

1. An electrodeless discharge lamp comprising a sealed discharge vessel containing a fill capable of sustaining a discharge when suitably energized, an RF electromagnetic field producing assembly in the vessel to energize the fill, and a light transmissive, inherently electrically conductive polymer layer on the exterior of the discharge vessel to confine the field within the lamp.

2. A lamp according to claim 1, wherein the layer comprises any one or more compound selected from the group consisting of:

Polyaniline

Polypyrrole

Polythiophene

Polyphenanthro-isothionaphthene and substituted derivatives thereof.

3. A lamp according to claim 2, wherein the compound is held in an inert lattice material.

4. A lamp according to claim 3, wherein the inert material is a silicone.

5. A lamp according to claim 1, wherein the discharge vessel has a re-entrant portion housing a solenoid for generating the RF field.

6. A lamp according to claim 5, further comprising an RF current generator for energizing the solenoid.

7. A lamp according to claim 1, further comprising a light transmissive electrically insulative layer over the conductive layer.

8. A lamp according to claim 1, wherein at least the conductive layer is either a dipcoat or a preformed molding.

9. A lamp according to claim 7, wherein the conductive layer and the insulative layer are co-molded.

10. A method for confining an RF electromagnetic field in an electrodeless discharge lamp the method including:

providing an electrodeless discharge lamp having an exterior surface; and providing a light transmissive, electrically conductive polymer layer on the exterior surface of the discharge vessel.

11. The method of claim 10 further comprising the step of providing an insulating layer on the exterior surface of the discharge vessel.

12. The method of claim 11 wherein the insulating layer is a compatible polymeric layer applied on the light transmissive, electrically conductive polymer layer.

* * * * *